United States Patent [19]

Niklès et al.

[11] Patent Number: 4,744,068

[45] Date of Patent: May 10, 1988

[54] TIMEPIECE SETTING ARRANGEMENT INCLUDING A SAFETY LOCK

[75] Inventors: Francois Niklès, Cressier; Cyril Vuilleumier, Bienne, both of Switzerland

[73] Assignee: ETA SA Fabriques d'Ebauches, Granges, Switzerland

[21] Appl. No.: 53,197

[22] Filed: May 22, 1987

[30] Foreign Application Priority Data

May 26, 1986 [CH] Switzerland ..... 02110/86

[51] Int. Cl.[4] ..... G04B 27/02

[52] U.S. Cl. ..... 368/190; 368/185

[58] Field of Search ..... 368/188, 190–199

[56] References Cited

U.S. PATENT DOCUMENTS

| | | | |
|---|---|---|---|
| 3,841,081 | 10/1974 | Komaki | 58/23 R |
| 3,866,407 | 2/1975 | Wuthrich | 368/35 |
| 3,982,388 | 9/1976 | Goyot et al. . | |
| 3,983,691 | 10/1976 | Schaller et al. | 368/31 |
| 4,060,977 | 12/1977 | Rochat | 368/35 |
| 4,201,040 | 5/1980 | Nakayama | 368/35 |
| 4,408,896 | 10/1983 | Ikegami | 368/185 |
| 4,634,287 | 1/1987 | Vuilleumier et al. | 368/185 |

FOREIGN PATENT DOCUMENTS 642220 4/1984 Switzerland .

OTHER PUBLICATIONS

Patent Abstracts of Japan, vol. 5, No. 118 (p-73) [790], Jul. 30, 1981. (no translation).

*Primary Examiner*—Bernard Roskoski

*Attorney, Agent, or Firm*—Griffin, Branigan & Butler

[57] ABSTRACT

The setting system of this invention includes a contactor provided with a blade adapted to come into repeated contact with a contact stud thereby to act on an electrical circuit. The contactor is operated by a stem bearing a crown and has a lock which prevents the blade from coming into accidental contact with the stud (for instance following a shock) when said stem is in its pushed-in rest position.

9 Claims, 4 Drawing Sheets

TIMEPIECE SETTING ARRANGEMENT INCLUDING A SAFETY LOCK

This invention concerns a timepiece setting arrangement including a stem bearing a crown adapted to be brought from a pushed-in rest position to a drawn-out working position and a contactor comprising a blade adapted to come into repeated contact with at least one contact stud thereby to act on an electrical circuit when the stem is rotated while in its drawn-out position.

BACKGROUND OF THE INVENTION

Several setting arrangements corresponding to the foregoing generic definition are known. U.S. Pat. No. 3,841,081 shows a blade 6 which cooperates with the teeth of a ratchet wheel 4 itself driven in rotation by a stem 1. When the stem is turned, the blade comes into repeated contact with a contact stud 10. Since the four teeth of the ratchet wheel are widely spaced apart from one another, it is foreseeable that the blade which exhibits a certain elasticity, may touch the contact stud in an untimely manner, thus giving rise to an undesirable electrical pulse and from there an unwanted setting signal should a shock be applied to the timepiece.

The setting arrangement for an electronic timepiece described in Swiss Pat. No. 642.220 likewise includes an arm 25 which, when the crowned stem is rotated, may come into repeated contact either with a first terminal 29 or with a second terminal 30 in accordance with the rotation sense of the stem. In this form also, the arm may come into untimely contact with one or the other of the mentioned terminals and thus bring about undesired setting. To overcome this difficulty, the cited arrangement provides a supplementary switch mechanism 33 which is engaged only when the stem is in the setting position, thus preventing all undesirable setting when the stem is in the rest position. This arrangement however has the disadvantage of complicating the construction and diminishing the reliability of operation of the timepiece.

SUMMARY OF THE INVENTION

To overcome the above cited difficulties, this invention relies on a lock controlled by the stem and arranged to limit the contactor blade travel when said stem is in the pushed-in position, so as to prevent said blade from coming into contact with said contact stud should a shock be applied to the timepiece.

DESCRIPTION OF THE PREFERRED EMBODIMENT

Figure 1:
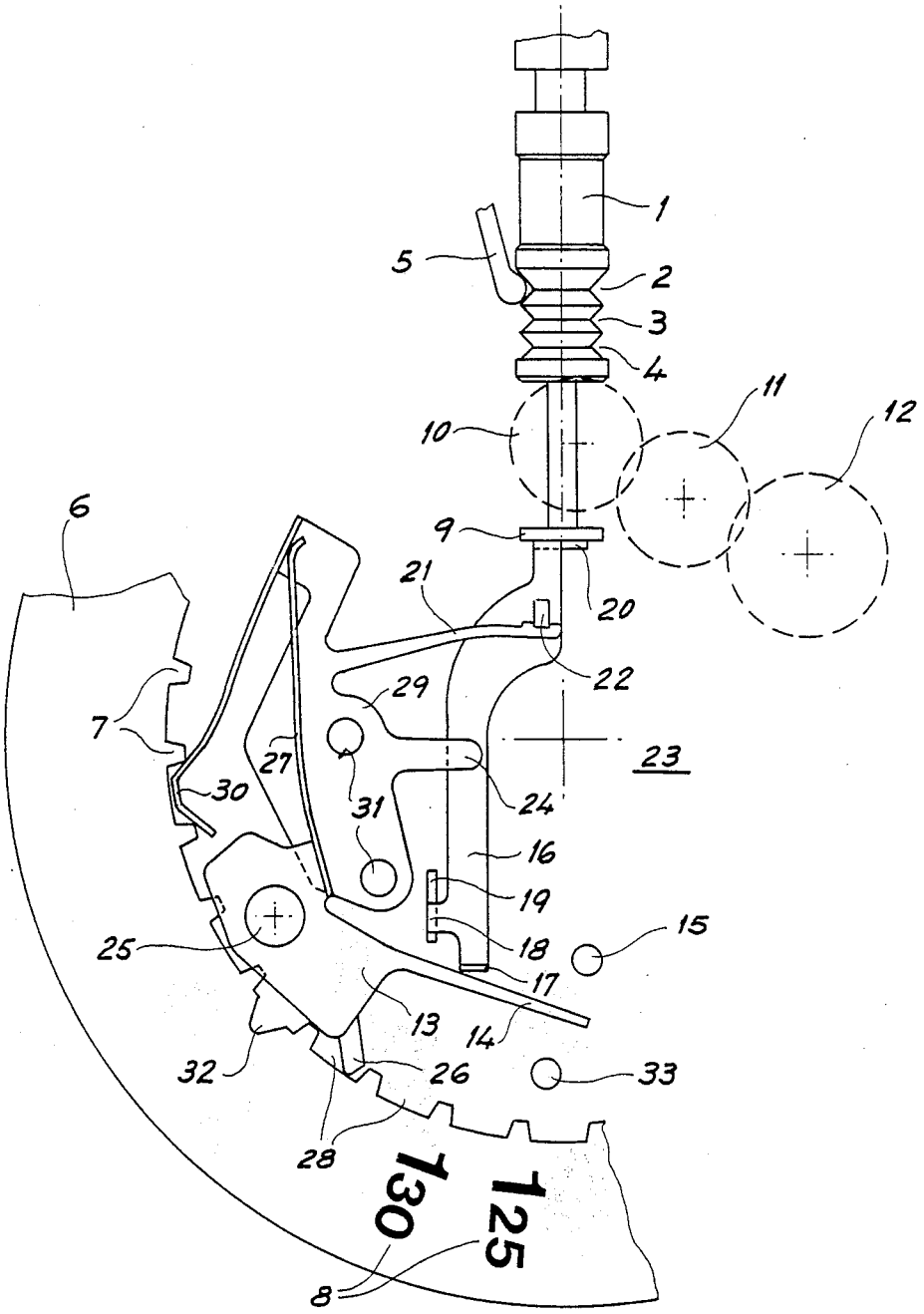
FIG. 1 is a plan view of the setting arrangement in accordance with the invention with the stem shown in the pushed-in rest position and where the lock is in its active position.

The first three figures show a timepiece including a stem 1 bearing a crown which may be brought into three axial positions defined by three grooves 2, 3 and 4 and a latching jumper spring 5. The timepiece further bears a ring 6 provided with interior teeth 7 and indications 8. This ring which is similar to that of the calendar ring of a watch, is driven in rotation if the stem is placed in its median position where the jumper 5 cooperates with groove 3 (FIGS. 2 and 3) and if the stem is caused to turn in an anti-clockwise sense. In this position a pinion 9 which forms an integral part of the stem is in mesh with a wheel 10 which in its turn drives wheels 11 and 12 and finally ring 6 by the teeth 7.

When stem 1 is in the neutral pushed-in position where jumper 5 cooperates with groove 2 as shown in FIG. 1, the pinion of stem 9 is no longer in mesh with wheel 10 and the ring 6 may no longer be driven in rotation.

The three figures further show that stem 1 may be displaced into a second extreme drawn-out position for which the jumper 5 penetrates into groove 4. Here it is the time setting position of the timepiece which is attained in a known manner for which it is unnecessary to enter into details at this point.

The horological mechanism taken as an example here is employed as a counter (or timer) either alone or incorporated into a watch which further indicates the time of day in a known manner. In the example ring 6 may be used not to indicate the date, but to display a period which, when it has run out, will set off an audible signal. Thus ring 6, instead of being driven by the wheel train of the time piece, is operated by the user of the watch directly by means of the stem 1 bearing the crown.

It is thus possible by means of stem 1 to bring ring 6 into any one of thirty-one positions, this number being chosen as a function of the usual positions in a timepiece provided with a date indicator. Here the indications 8 borne by the ring represent periods in minutes extending over successive five minute intervals. Indications 8 appear one after the other through an aperture (not shown) generally situated at 3 o'clock in the timepiece.

As an example of the adjustment of the mechanism in question, it will be supposed that it is 9 o'clock and that the watch user wishes to be warned at 11 o'clock which is to say two hours later. He will withdrawn the stem 1 to the median position, turn it until the indication 0 appears through the aperture, then continue to turn it until the indication 2h00 appears through the aperture and finally push it back into the neutral pushed-in position.

To set into action the desired counting function, the timepiece includes a contactor 13 provided with a blade 14 adapted to come into repeated contact with at least one contact stud 15 so as to act on an electrical contact when the stem is rotated in its drawn-out position.

In accordance with the invention, the timepiece comprises a lock 16 which is operated by the stem 1 and which is arranged so as to limit the travel of blade 14 when stem 1 is in the pushed-in position, in a manner such as to prevent said blade from coming into contact with stud 15 when a shock is applied to the timepiece. This situation is shown on FIG. 1. Lock 16 has the aspect of a flat elongated member provided at one end with a folded over edge 17 which constitutes a buffer limiting the travel of the blade. The lock is longitudinally guided by another folded over edge 18 which cooperates with an opening 19 provided in the watch movement. The lock is constantly applied at its second end 20, likewise folded over, against pinion 9 by a spring 21 which acts on a catch 22 struck out of the lock 16. The lock is mounted on a support plate 23 which forms part of the movement and is retained in the sense of its height on one hand by spring 21 and on the other hand by a tongue 24.

Thus, as is shown on FIG. 1 where the stem is in the rest position, the blade 14 of contactor 13 is prevented from being brought into contact in an untimely manner with stud 15 should a shock be applied to the timepiece.

Figure 2:
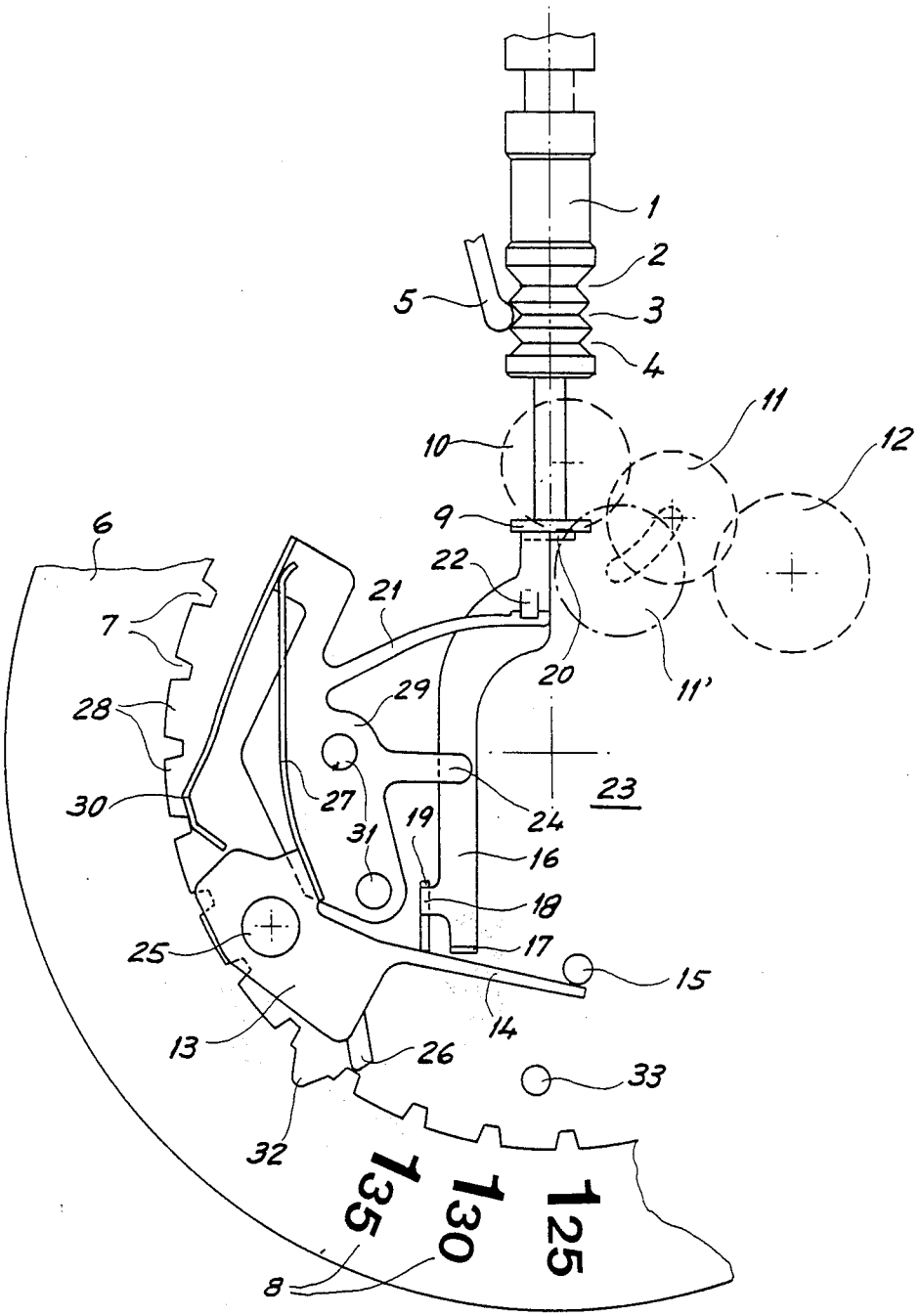
FIG. 2 is the same plan view as that of FIG. 1 but in which the stem is in the drawn-out working position and the lock in the retracted position, the contactor blade being in contact with a first stud.

Referring now to FIG. 2, it will be seen that stem 1 is in its drawn-out working position. In withdrawing the stem, lock 16 is displaced upwards on the figure, having thus been urged by spring 21 which permanently urges the second end 20 of said lock against the pinion of stem 9. The blade 14 of contactor 13 may then be brought into contact with stud 15.

As shown by the drawing and in accordance with a secondary characteristic of the invention, contactor 13 is a lever arranged to pivot about a fixed axis 25, said lever comprising, in addition to the contact blade 14, a feeler 26 cooperating with a toothed member controlled by the stem, in this case the interior teeth 7 of ring 6. The contactor includes further a return spring 27 which urges feeler 26 against the teeth of the ring. In this manner blade 14 comes into electrical contact with stud 15 each time that the feeler passes onto a tooth 7 of the ring (FIG. 2) and similarly it is separated from said stud each time that said feeler is found in a gap 28 separating two teeth (FIG. 1). In the case shown on FIG. 2, it is seen that lock 16 is arranged out of the field of action of the blade and that the blade 14 passes from a contact position to a position where contact is broken.

In accordance with a further secondary characteristic of the invention, the arrangement further includes a plate 29 which is cut out and folded in a manner such that it provides a jumper spring 30 for positioning ring 6 and the spring 21 which has been mentioned above for urging lock 16 against stem 1. Plate 29 is fastened to the movement by pins 31. The drawing shows furthermore that the tongue 24 is cut out of plate 29 as mentioned hereinabove and serves to retain lock 16.

Figure 3:
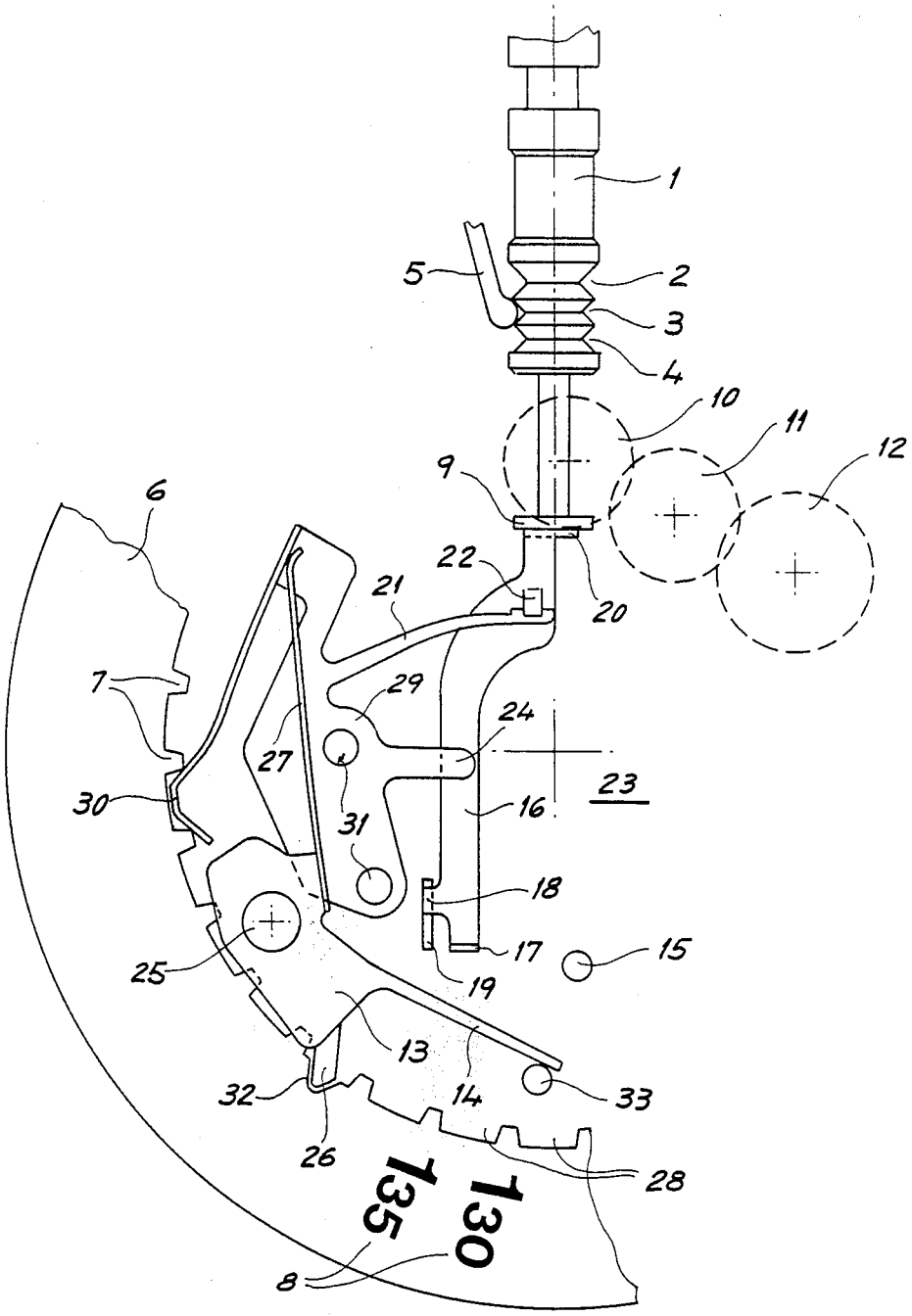
FIG. 3 shows a situation resembling that of FIG. 2, but in which the contactor blade is in contact with a second stud

Finally, in accordance with still another secondary characteristic of the invention, it is seen on the drawing that ring 6 includes a notch 32 arranged between two teeth 7 and which is deeper than the gaps 28 arranged between the other teeth. FIG. 3 shows that when the feeler 26 of contactor 13 is at the bottom of notch 32, the blade 14 comes into electrical contact with a second stud 33. Thus, blade 14, in accordance with whether the feeler is at the bottom of notch 32, at the bottom of a gap 28 or at the top of a tooth 7, will be brought to touch stud 33, will be found midway between studs 33 and 15 or will be brought into contact with stud 15 respectively. In the arrangement shown on the drawing, it is seen that there is no risk that blade 14 is brought to contact stud 33 in an untimely manner it being held back by feeler 26. Alternatively however for this case a second lock could be employed to prevent blade 14 from moving in the direction of stud 33, such second lock likewise being controlled from the stem by means of a lever arm.

Each time that blade 14 contacts stud 15 likewise referred to as the incrementation stud, there is generated an electrical pulse which is counted by an electronic circuit according to a procedure which will be described hereinafter. The number of pulses thus gathered in represents the position of ring 6 and thus the period chosen by the watch user, this from a departure point indicated by the zero setting of the ring, this zero setting taking place when the feeler 26 penetrates into notch 32, thus bringing about the contact of blade 14 with stud 33 also referred to as the zero reset stud.

The construction shown by the drawing is arranged in order that the ring may not be driven other than in one sense, here when the crowned stem 1 is rotated in the anti-clockwise sense. To this effect wheel 11 is on a sliding pivot mounted between wheels 10 and 12. As may be seen on FIG. 2, wheel 11 is in mesh with wheels 10 and 12 when stem 1 is rotated in the counter clockwise sense. On the other hand wheel 7 occupies a position 11' if the stem is rotated in the clockwise sense.

Figure 4:
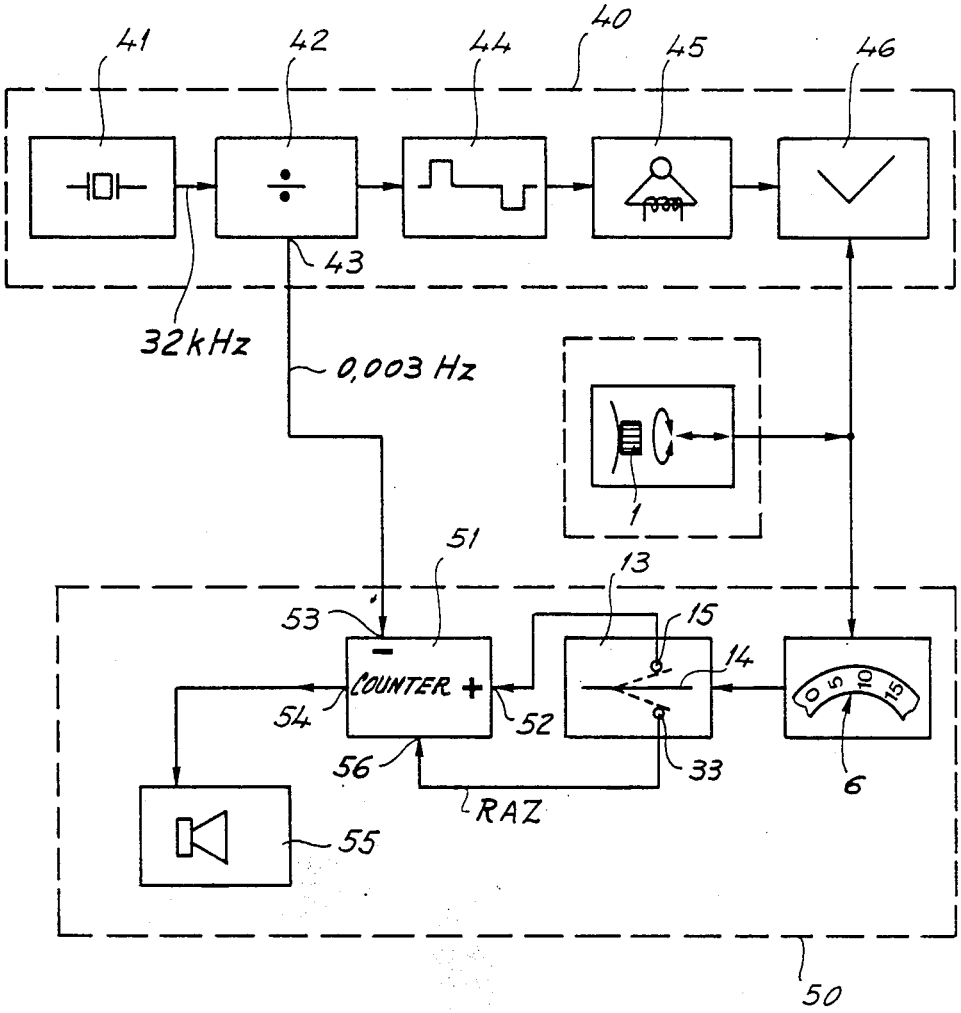
FIG. 4 is a schematic of the electronic circuit to which the setting arrangement shown in FIGS. 1 to 3 is coupled.

FIG. 4 shows a schematic drawing of an electrical circuit which may be employed in the watch shown on FIGS. 1 to 3. This circuit includes a portion 40 specifically intended to indicate the time of day and a portion 50 which assures the counting function in cooperation with stem 1, ring 6 and the blade 14 of contactor 13.

In a known manner portion 40 includes a quartz oscillator 41 providing a signal the frequency of which is about 32 kHz. This oscillator is connected to a divider 42 of which one of the outputs 43 is coupled to the portion 50 of the circuit, the signal appearing at this output being formed by a series of pulses spaced apart by five minutes (0.003 Hz), at least in the example shown here. In a known manner the divider is coupled to a pulse forming circuit 44 itself coupled to a stepping motor 45 driving the hands 46 of the watch via the wheel train.

Contactor 13 is connected to an accumulator circuit 51 which in this example is a simple up/down counter, the counting input 52 being coupled to the contact stud 15 of the contactor, the count down input 53 to the output 43 of the divider and the zero output 54 to a signalling device 55 providing an audible or like signal when the up/down counter 51 reaches position 0. This counter likewise includes a reset-to-zero input 56 to which is connected the contact stud 33. The signalling device 55 is provided with a time delay arrangement for assuring the generation of an alarm signal only during a certain time following arrival of the up/down counter at its zero setting.

The operation of the circuit of FIG. 4 is as follows: when the user wishes to employ the counter to fix a time interval to be measured, he initially places stem 1 in the drawn-out work position such as shown on FIGS. 2 and 3. He turns the stem until the figure 0 appears in the aperture. At this moment as is seen on FIG. 3, feeler 26 is at the bottom of notch 32 and blade 14 comes into contact with stud 33 which has as effect to set the up/-down counter 51 to zero. The user then turns stem 1 until the figure corresponding to the desired duration in minutes appears within the aperture. During this operation, the up/down counter is loaded at the same rate as the teeth pass by the feeler 26. The up/down counter 51 will thus have recorded a certain number of pulses created by the repeated contacts of blade 14 with stud 15 and corresponding to as many periods of five minutes as make up the time interval to be measured. As soon as this interval has been set into the circuit, the time base formed by oscillator 41 and divider 42 bring about countdown of the contents of the up/down counter 51 at the rate of one pulse every five minutes, the period to be measured being ended when the up/down counter 51 reaches zero. At this instant alarm 55 is operated to warn the user that the time interval has run out.

From the above description it will be seen that if lock 16 were to be removed, the blade could readily come into contact with the incrementation stud 15 when shocks were applied to the timepiece. Untimely contacts would have as effect to load the counter with undesired pulses and the displayed time interval would then not correspond to the period introduced into counter 51.

The foregoing description has taken as example a counter or timer system in which a manual control acts in a repeated fashion on an electrical contact. The invention is not limited to the example as illustrated, but generally covers all systems involving a manually controlled contactor such as those described in the documents cited in the introduction to the present description, provided that such systems have security locks preventing untimely contacts occurring on the occasion of shocks applied to a timepiece.

What we claim is:

1. A timepiece setting arrangement including a stem bearing a crown and adapted to be brought from a pushed-in rest position to a drawn-out working position and a contactor comprising a blade adapted to come into repeated contact with at least one contact stud thereby to act on an an electrical circuit when the stem is rotated while in its drawn-out position and further comprising a lock controlled by the stem and arranged to limit the blade travel when said stem is in the pushed-in position thereby to prevent said blade from coming into contact with said stud when a shock is applied to the timepiece, said contactor comprising a lever pivoting about an axis and including an addition to said blade a feeler cooperating with a toothed part operated by the stem when said stem is in its drawn-out position and a return spring urging said feeler against the teeth of said toothed part so as to permit said blade to make electrical contact with said stud each time that said feeler passes onto a tooth and to be separated from said stud when the feeler is located in the gap separating two teeth, said lock being removed from the field of action of said blade when said stem is in the drawn-out position.

2. A setting arrangement as set forth in claim 1 wherein the toothed part comprises a ring bearing interior teeth and indications appearing through an aperture.

3. A setting arrangement as set forth in claim 1 further including a plate which is cut out and folded in a manner such that it provides a jumper spring for positioning the ring and a return spring for urging the lock against the stem.

4. A setting arrangement as set forth in claim 2 wherein the ring includes a notch arranged between two teeth cut deeper than the gaps occurring between the other teeth, the arrangement having a second stud arranged to come into contact with the blade when the feeler is at the bottom of said notch.

5. A timepiece setting arrangement including a stem bearing a crown and adapted to be brought from a pushed-in rest position to a drawn-out working position and a contactor comprising a blade adapted to come into repeated contact with at least one contact stud thereby to act on an electrical circuit when the stem is rotated while in its drawn-out position and further comprising a return spring, a lock comprising an elongated slide-bar having a first extremity which is urged against the stem by means of said return spring acting on said lock and a second extremity of which is arranged to limit the blade travel when said stem is in the pushed-in position thereby to prevent said blade from coming into contact with said stud when a shock is applied to the timepiece, and guiding means to maintain said lock in a determined path.

6. A setting arrangement as set forth in claim 5 wherein the contactor is a lever pivoting about an axis and includes in addition to said blade a feeler cooperating with a toothed part operated by the stem when said stem is in its drawn-out position, and a second return spring urging said feeler against the teeth of said toothed part so as to permit said blade to make electrical contact with said stud each time that said feeler passes onto a tooth and to be separated from said stud when the feeler is located in the gap separating two teeth, said lock being removed from the field of action of said blade when said stem is in the drawn-out position.

7. A setting arrangement as set forth in claim 6 wherein said toothed part comprises a ring bearing interior teeth and indications appearing through an aperture.

8. A setting arrangement as set forth in claim 6 and further including a plate which is cut out and folded in a manner such that it provides a jumper spring for positioning the ring and said first return spring for urging the lock against the stem.

9. A setting arrangement as set forth in claim 7 wherein said ring includes a notch arranged between two teeth and cut deeper than the gaps ocurring between the other teeth, the arrangement having a second stud contacted by the blade when the feeler is at the bottom of said notch.

* * * * *